US006612145B2

(12) United States Patent
Rohleder

(10) Patent No.: US 6,612,145 B2
(45) Date of Patent: Sep. 2, 2003

(54) LEVELER FOR STRETCHER LEVELING OF A METAL STRIP OR SHEET

(75) Inventor: Dietmar Rohleder, Hilchenbach (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/876,275

(22) Filed: Jun. 7, 2001

(65) Prior Publication Data

US 2002/0046589 A1 Apr. 25, 2002

(30) Foreign Application Priority Data

Jun. 7, 2000 (DE) ..... 100 28 306

(51) Int. Cl.[7] ..... B21D 1/02
(52) U.S. Cl. ..... 72/164; 72/238
(58) Field of Search ..... 72/164, 165, 160, 72/239, 238, 226

(56) References Cited

U.S. PATENT DOCUMENTS 2,527,309 A * 10/1950 Heller ..... 193/32
3,326,026 A * 6/1967 Guillot ..... 72/163
3,494,166 A * 2/1970 Severin ..... 72/239
4,030,332 A * 6/1977 Koch et al. ..... 72/164
4,632,655 A * 12/1986 Benkwitz ..... 72/238
4,823,582 A * 4/1989 Bourbon et al. ..... 72/164
5,184,492 A * 2/1993 Ushigami ..... 72/160
5,666,836 A * 9/1997 Bonnefont et al. ..... 72/164

* cited by examiner

*Primary Examiner*—Daniel C. Crane
(74) *Attorney, Agent, or Firm*—Sidley Austin Brown & Wood, LLP

(57) ABSTRACT

A leveler for stretcher-leveling of a metal strip or sheet and including a frame, at least two roller leveling units supported in the frame and arranged, respectively, above and below a rolled stock, and a guide for displacing the roller leveling units between their operational position and their roller maintenance and exchange position thereof, with each of the roller leveling units including a roller magazine including at least one leveling roller and having a support unit for supporting the leveling roller and pivotally arranged on the run-in side or the run-out side of the roller magazine for pivotal movement between operational and maintenance and exchange positions.

7 Claims, 5 Drawing Sheets

LEVELER FOR STRETCHER LEVELING OF A METAL STRIP OR SHEET

BACKGROUND OF THE INVENTION

1. Field of the Invention

The present invention relates to a leveler for stretcher-leveling of a metal strip or sheet and including a frame, at least two roller leveling units supported in the frame and arranged, respectively, above and below a rolled stock, and a guide for displacing the roller leveling units between their operational position and their roller maintenance and exchange position, with each of the roller leveling units including a roller magazine including at least one leveling roller rotatable about its longitudinal axis, and an adjusting element for displacing the roller leveling unit toward and away from the rolled stock.

2. Description of the Prior Art

As is known, during stretcher leveling of metal sheet material or strips in order to obtain sheet material and strips with a high flatness and a minimal residual internal stress, the sheet material or strips is (are) fed through a leveling clearance formed by upper and lower leveling rollers and corresponding to the cross-section of the sheet material or the strip.

European Publication EP 0 446 130 B1 discloses a leveler for stretcher-leveling a metal strip with at least two roller leveling units offset in the displacement direction of the strip and arranged above and below the strip. The leveler further includes guide and control means for displacing both units vertically between an operational position and an idle position in which the roller leveling units are spaced from the strip. Each roller leveling unit includes a chassis or a roller magazine including at least one leveling roller rotatable about its axis. For maintenance or for changing the rollers, both roller leveling units are displaced, transverse to the strip displacement direction, by a changing device sidewise of the leveler frame. When the lower roller leveling unit or the lower leveling roller is subjected to a maintenance work or is being replaced, the roller(s) of the upper roller leveling unit are accessible only with much difficulties. In order to improve the accessibility of the upper rollers, it is suggested to rotate the entire upper roller leveling unit about its longitudinal axis by 180° to bring the rollers into an upper position.

To bring the roller(s) into the upper position, it is suggested to pivotally mount the chassis on two opposite aligned journals which are supported in opposite support elements. The journals define a horizontal axis about which the entire upper roller leveling unit pivots between an operational position, in which the leveling roller(s) face(s) downwardly, and a maintenance and exchange position in which the roller(s) face(s) upwardly.

The solution suggested in EP 0 446 130 B1 is rather expensive as means needs to be provided for rotating the entire upper roller leveling unit to insure access to the leveling roller(s) of the upper unit for maintenance and exchange purposes.

Accordingly, an object of the present invention is to provide a leveler of the type described above in which the roller(s) of the upper leveling unit could be made accessible for maintenance and exchange without the need to rotate the entire upper roller leveling unit about its horizontal axis.

SUMMARY OF THE INVENTION

This and other objects of the present invention, which will become apparent hereinafter, are achieved by providing a leveler in which the roller magazine of the upper roller leveling unit has a support unit for supporting the leveling roller and pivotally arranged on a run-in side or run-out side of the roller magazine for pivotal movement between operational and maintenance and exchange positions.

The advantage of the solution according to the present invention consists in that only the roller(s) of the upper roller leveling unit and their support means need to be rotated to bring the roller(s) in its (their) maintenance and exchange position. As the present invention is directed primarily to the upper roller leveling unit, the roller support unit is arranged beneath the roller magazine. The pivot angle between the operational position and the pivoted position is so selected that the access to the roller(s) for maintenance and exchange purposes is insured.

Accordingly to an advantageous embodiment of the present invention the support unit includes at least two roller housings for supporting opposite ends of the leveling roller, two brackets for supporting the at least two roller housings and pivotally arranged on the roller magazine, and fastening means, preferably screw means, for releasably secure the brackets at their side opposite their pivot points to the roller magazine for retaining the support unit in the operational position.

In order to improve handling of the upper roller leveling unit, there are provided on the end side of the roller magazine, i.e., on the side of the roller magazine extending parallel to the strip displacement direction, at least two spring elements cooperating with respective brackets and dimensioned in such a way that a total gravity force of the housings, including the respective leveling rollers, and the brackets is compensated by spring forces. The spring elements can be formed as gas springs, hydraulic springs, or mechanical springs. When a gas pressure spring is used, the rod head is displaced past its dead point during the pivotal movement, which insures the support unit in its maintenance and exchange position against a possible rebound.

Generally, a manual pivoting of the support unit is contemplated. However, it is also possible to use different manipulators connectable with the support unit for pivoting same.

For synchronization of the pivotal movement of both roller housings, there is provided a stirrup which serves as a handle, extends along the longitudinal axis of the roller magazine, i.e., transverse to the strip displacement direction, and is connected, at its opposite ends, with the two brackets, which are located on the drive and operator's side of the roller magazine.

Generally, the pivotal movement is effected in the idle position of the roller leveling unit, i.e., in the position in which the roller leveling unit is spaced from the strip. However, for security and handling reasons, there is provided guide means for displacing the roller leveling units horizontally toward the strip delivery place and to the maintenance and exchange position which is located adjacent to the leveler frame.

The present invention also includes a system for stretcher-leveling of a metal strip, in particular, a cold-rolled or hot-rolled thin slab and which includes a plurality of levelers described above, or a single leveler with a plurality of roller leveling units, e.g., six, together with control means controlling the strip displacement.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
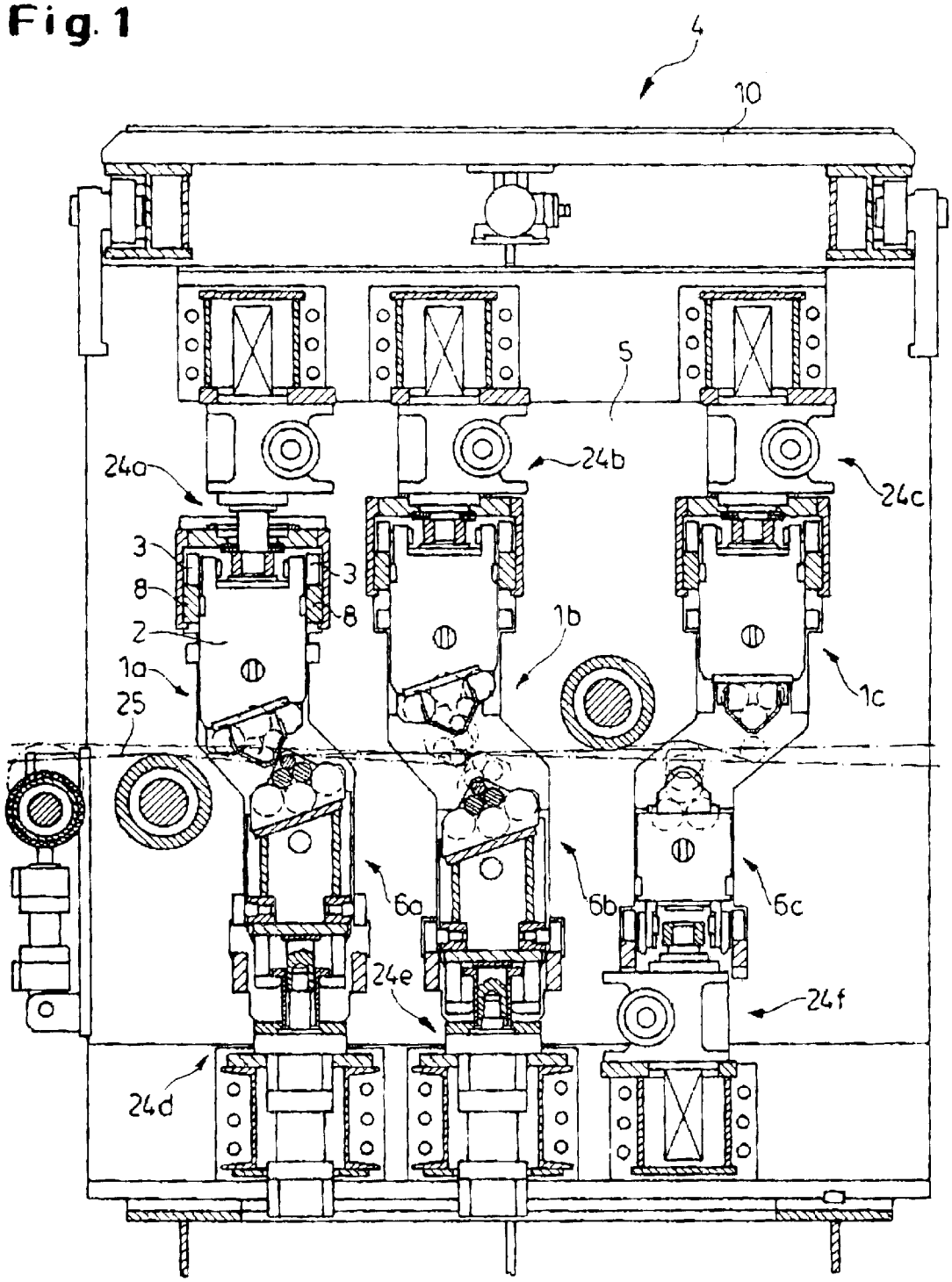
FIG. 1 a cross-sectional view of a leveler according to the present invention with six roller leveling units.
Figure 2:
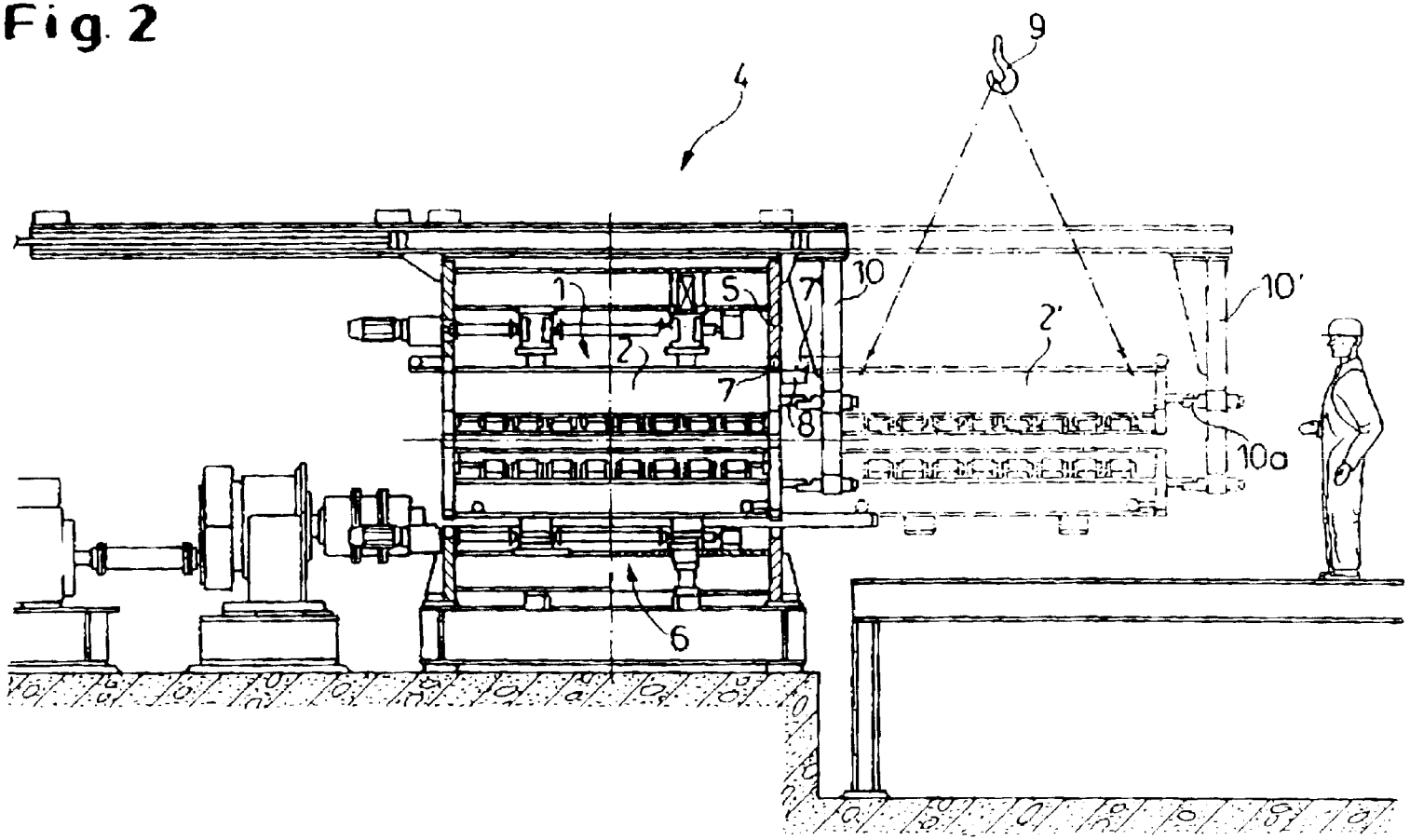
FIG. 2 a longitudinal cross-sectional view of a leveler according to the present invention with a changing device.

FIGS. 1–2 show, respectively, longitudinal and transverse view of a leveler 4 according to the present invention for stretcher-leveling of a metal strip 25. Now, pivoting of the support unit on a roller magazine, which is effected according to the present invention, will be described in detail with reference to FIGS. 3–6. As shown in FIG. 1, three upper roller leveling units 1*a*, 1*b*, 1*c* and three lower roller leveling units 6*a*, 6*b*, 6*c* are arranged one behind the other in a frame 5 of a leveler 4. The roller leveling units 1*a*–1*c* and 6*a*–6*c* are provided with adjusting means 24*a*, 24*b*, 24*c* and 24*d*, 24*e* and 24*f*, respectively, which displace respective roller leveling units 1*a*–1*c* and 6*a*–6*c* substantially vertically into their operational positions and which retain the roller leveling units in their positions. Each of the roller leveling units 1*a*–1*c* is formed of a roller magazine 2 which has as its end, remote from the strip 25 or from the leveling roller, guide rollers 3 displaceable along guide rails 8 for displacing the respective roller leveling units between a first operational position in the frame 5 and a second, maintaining and exchange position provided adjacent to the frame 5 as shown in FIG. 2. The guide rails 8 extend transverse to the width of the frame 5. In the pull-out position of the roller leveling units, only the rear guide rollers 7' contact the guide rails 8, with the front end of the roller magazine 2 being supported on the retracted changing and displacement device 10' (10" in the operational position) by a stub shaft 10*a*. A crane (schematically shown as a hook 9) supports the magazine frame removed from the magazine when the frame is unnecessary for rollers, here, back-up rollers, which are not displaced in the roller magazine.

Figure 3:
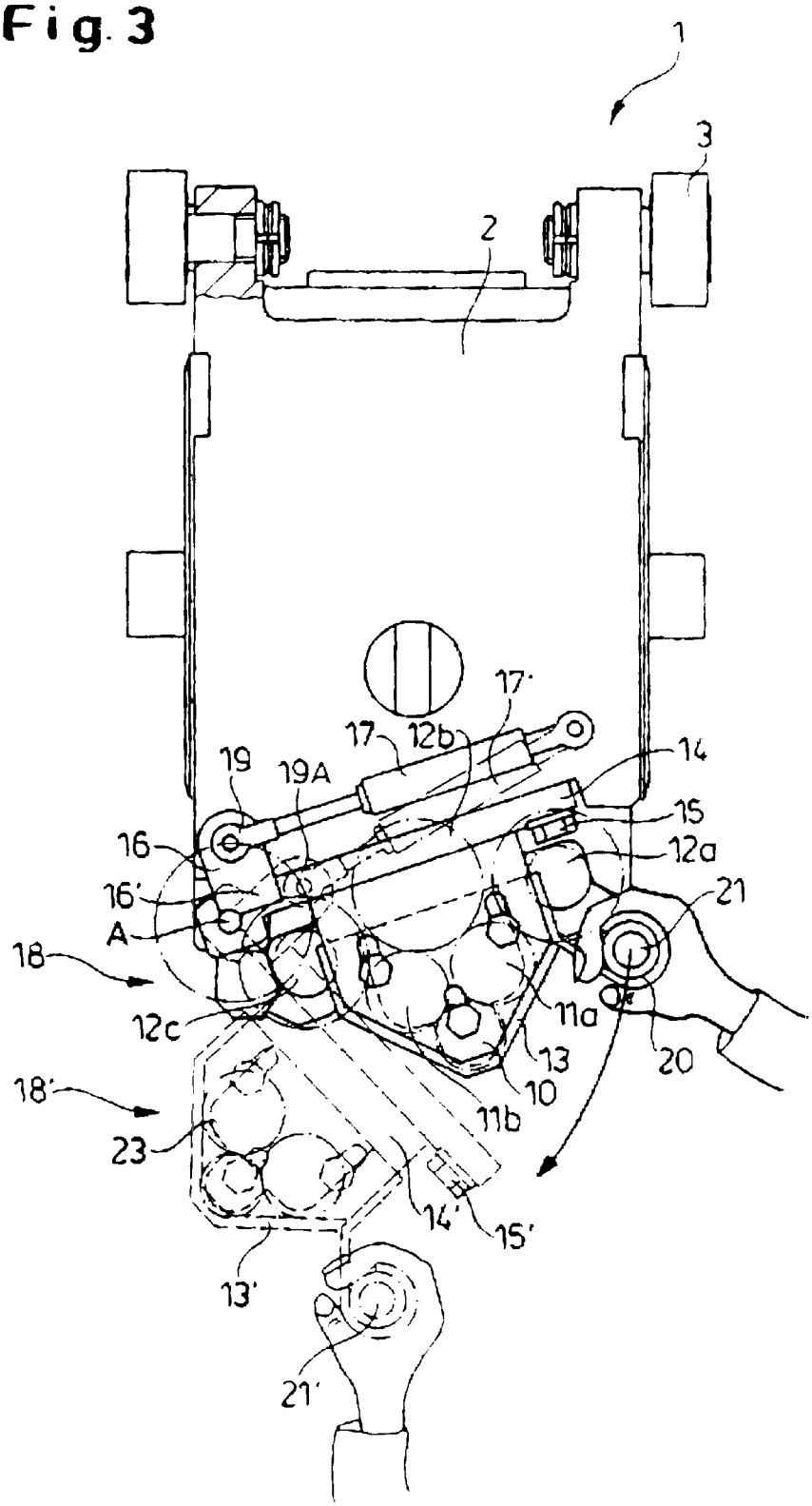
FIG. 3 a side view of an upper roller leveling unit of a leveler according to the present invention with a support unit in closed and maintenance and exchange positions.

Pivoting arrangement of rollers with respect to the roller magazine 2 according to the present invention of the upper roller leveling unit 1*a*, 1*b*, 1*c* will now be described in detail with reference to FIG. 3. The stretcher-leveling rollers extend along a lower portion of the roller magazine 2 of the upper roller leveling unit. The stretcher-leveling rollers include a leveling roller 10 arranged between two intermediate rollers 11*a*, 11*b* which are supported by three back-up rollers 12*a*, 12*b*, 12*c* (please see FIG. 4). The leveling roller 10 and the intermediate rollers 11*a*, 11*b* are supported at their opposite ends in roller housings 13. Each roller housing 13 is connected with a bracket 14 which is pivotally supported at a point A on the lower portion of an end surface of the roller magazine 2. The pivot point A can be provided either on a strip run-in side or a strip run out side of the roller magazine 2. At its side opposite the pivot point A, the bracket 14 is releasably secured with screw means 15 to the end side of the roller magazine. A gas pressure spring 17 applies, via a lever 16, a biasing force to the bracket 14.

The roller housing 13, the bracket 14, and the gas pressure spring 17 are provided on both the drive side and the operator' side of the roller magazine 2. The roller housing 13, the bracket 14, and the gas pressure spring 17 form together a support unit 18 which provides for a pivotal movement of the rollers 10, 11*a*, 11*b*, which are supported in the roller housing 13, about a pivot axis. Upon the pivotal movement, the bracket 14 pivots about the pivot point A. In the embodiment shown in the drawings, the pivot angle amounts to about 66°, more precisely to 65.6°. The pivotal position of the support unit 18 is shown with dash lines. Upon pivoting, the rod head 19 of the gas pressure spring 17, which is connected with the lever 16 connected with the bracket 14, is displaced toward the gas-filled cylinder of the gas pressure spring 17 and, thus, against the biasing force, slightly past the spring dead point (here, point 19*a*). This displacement of the rod head 19 insures retaining of the support unit 18 in its maintaining and exchange position (the support unit bears the reference numeral 18' in this position) against any rebound.

A lever 20, which is secured to the roller housing 13, serves as stirrup for synchronization the movement of the drive side and operator's side brackets 14. The stirrup simultaneously serves as a handle 21 that provides for an easy pivoting of the support unit 18.

In the embodiment shown in the drawings, the lower surface of the respective e side of the roller magazine 2 is inclined, providing an inclined support surface for the bracket 14 or the support unit 18. The angle of inclination amounts to about 20° in order to improve the contact of the leveling roller 10 with the strip 25 in the operational position of the roller leveling unit, and to prevent displacement of the roller from its rest during the stretcher leveling. Simultaneously, this inclination angle insures, in comparison with a horizontal arrangement of the bracket on the roller magazine, an easier access to the support unit for the maintenance personnel and, thus, improves handling of the support unit. Of course, a horizontal arrangement of the bracket 14 is not out of question, with a horizontal support surface (See FIG. 5).

Figure 4:
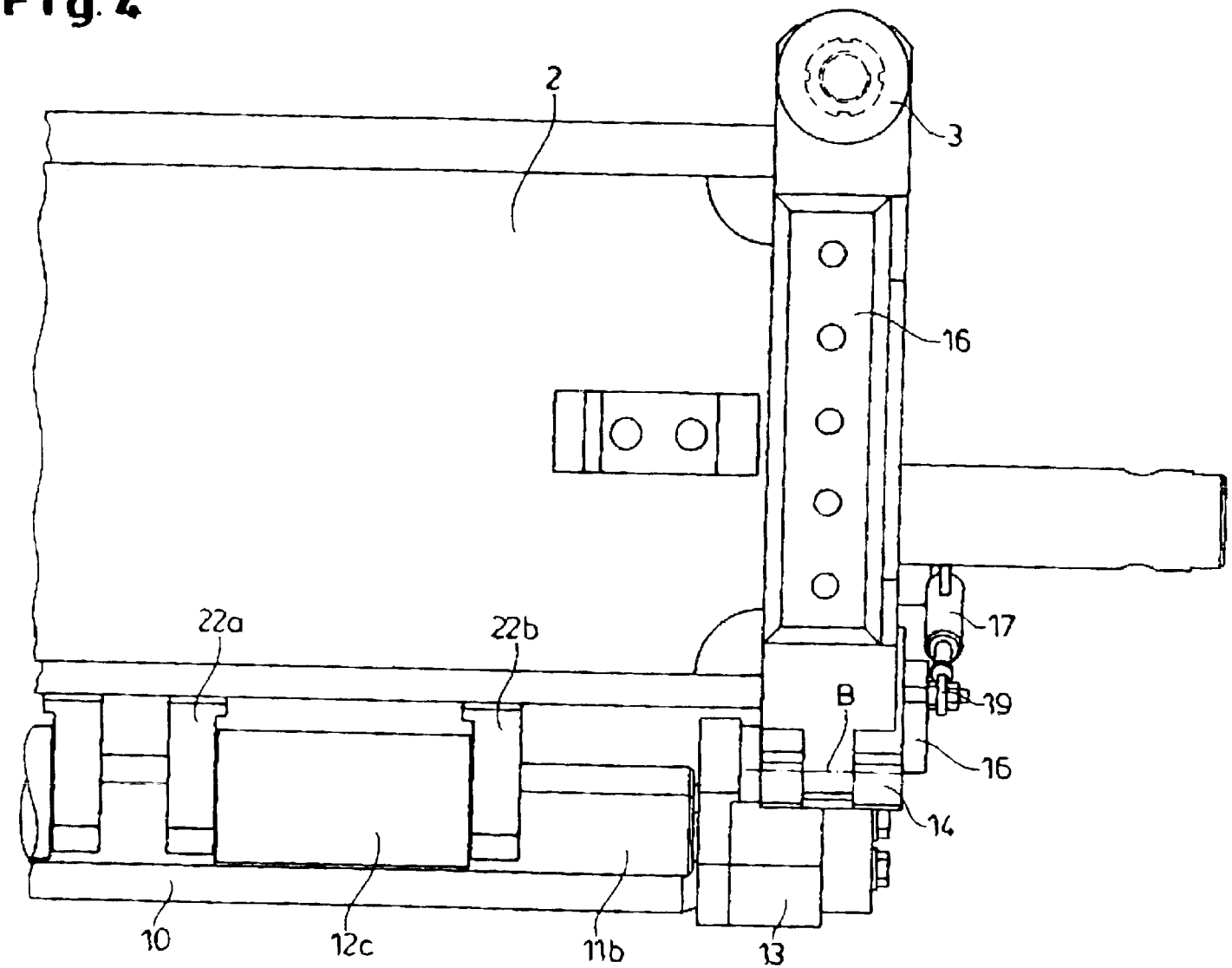
FIG. 4 a front view of a portion of an upper roller levelling unit shown in FIG. 1.

FIG. 4 shows the support unit 18 in its operational (non-pivotal) position. It can be clearly seen, that the ends of the leveling roller 10 and of both intermediate rollers (only the roller 11*b* is visible in FIG. 4) are supported in the roller housing 13. The leveling and intermediate rollers are supported by respective back-up rollers (only the back-up roller 12*c* is shown in the figure). The back-up rollers are mounted in bearing blocks 22*a*, 22*b* fixedly secured on the roller magazine 2, with a possibility to pivot about respective attachment points. They are not pivoted together with the roller housing 13. The pivot axis of the bracket 14 or the support unit 18 is designated with a reference character B.

Figure 6:
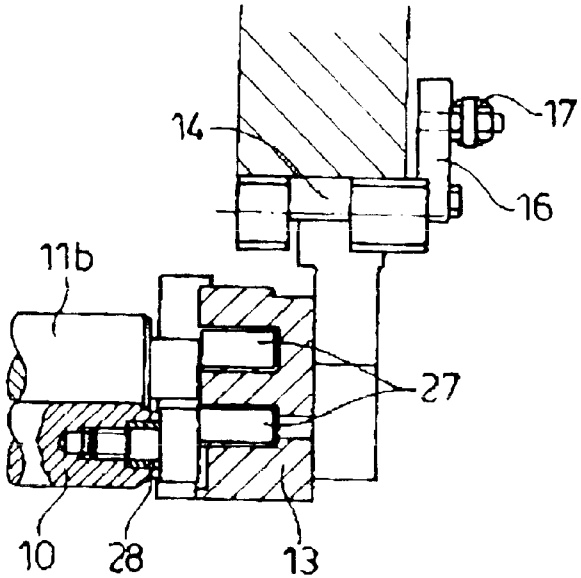
FIG. 6 a vertical cross-sectional view of the support unit shown in FIG. 5.
Figure 5:
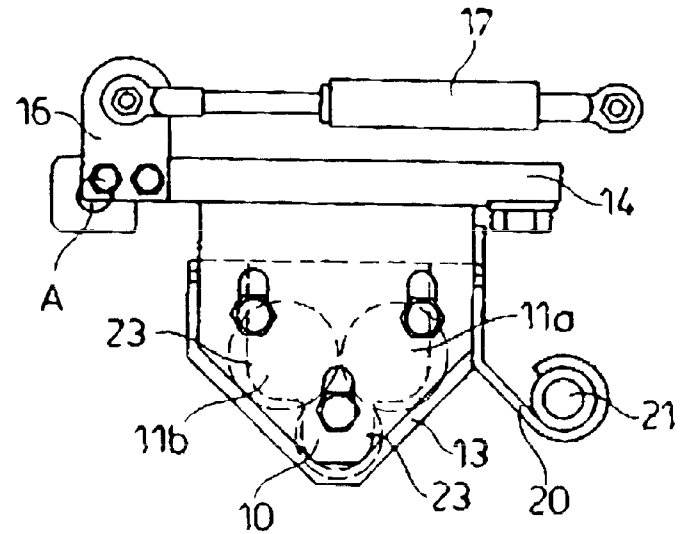
FIG. 5 a side view of a support unit with a horizontally arranged bracket.

In comparison with FIG. 5, FIG. 6 shows only a portion of the support unit 18 shown in FIG. 5 in its pivotal position. The roller housing 13 is provided with receiving recesses 23 facilitate replacement of the rollers. The intermediate rollers (again, only the roller 11*b* is shown) are arranged radially and are axially displaced by off-center rollers 27. The leveling roller 10 has a radial bearing 28 mounted therein.

Generally, the present invention provider a support unit for leveling rollers which insures an easy access thereto and its easy handling. The present invention is not limited to a particular number of rollers, and the pivotal housing can be adapted for different number of pivotal rollers and for different types of rollers.

Though the present invention was shown and described with references to the preferred embodiment, such is merely illustrative of the present invention and are not to be construed as a limitation thereof, and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A leveler for stretcher leveling of a metal strip or sheet, comprising a frame; at least two roller leveling units supported in the frame and arranged, respectively, above and below a roller stock; and guide means for displacing the roller leveling units between an operational position thereof and roller maintenance and exchange position thereof, wherein each of the roller leveling units includes a roller magazine including at least one leveling roller rotatable about a longitudinal axis thereof, the roller magazine being movable into the frame and adjacent the frame and adjusting means for displacing the roller leveling unit toward and away from the roller stock, and wherein at least the roller magazine of the upper roller leveling unit has a support unit for supporting the leveling roller, the adjusting means comprising a pivotal arrangement for the support unit on a lower side of the roller magazine facing the to-be-stretcher leveled metal strip or sheet and arranged on one of run-in side and run-out side of the roller magazine for pivotal movement of the support unit between operational position and maintenance and exchange positions by an angle large enough to insure an unobstructed access to the leveling roller in the maintenance and exchange position, and wherein the support unit includes at least two roller housings for supporting opposite ends of the leveling roller, two brackets for supporting the at least two roller housing and pivotally arranged on the roller magazine, and fastening means for releasably securing the brackets at a side thereof opposite a pivot point thereof to the roller magazine for retaining the support unit in the operational position thereof.

2. A leveler as set forth in claim 1, wherein the support unit has at least two spring elements cooperating with respective brackets and dimensioned in such a way that a total gravity force of the housings, including the respective leveling rollers, and the brackets is compensated by spring forces.

3. A leveler as set forth in claim 2, wherein the spring elements are formed as one of gas spring, hydraulic spring, and mechanical spring.

4. A leveler as set forth in claim 3, further comprising a pivot lever secured on the support unit.

5. A leveler as set forth in claim 4, wherein the pivot lever is formed as a stirrup connected at opposite ends thereof with the brackets which are provided on the run-in and run-out sides of the roller magazine, respectively.

6. A leveler as set forth in claim 1, wherein the roller housings have pockets for receiving the ends of the leveling roller.

7. A leveler as set forth in claim 1, wherein the roller magazine further includes two intermediate rollers arranged on opposite sides of the leveling roller and having ends thereof supported in respective roller housings.

* * * * *